US006382790B1

(12) United States Patent
Girod

(10) Patent No.: US 6,382,790 B1
(45) Date of Patent: May 7, 2002

(54) METHOD FOR PRODUCING A MULTIFOCAL CORRECTION LENS, AND SYSTEM FOR IMPLEMENTING SAME

(76) Inventor: Denis Girod, 71, boulevard de Strasbourg, 76600 Le Havre (FR)

( * ) Notice: Subject to any disclaimer, the term of this patent is extended or adjusted under 35 U.S.C. 154(b) by 0 days.

(21) Appl. No.: 09/763,795

(22) PCT Filed: Aug. 27, 1999

(86) PCT No.: PCT/FR99/02054

§ 371 Date: Feb. 27, 2001

§ 102(e) Date: Feb. 27, 2001

(87) PCT Pub. No.: WO00/12261

PCT Pub. Date: Mar. 9, 2000

(30) Foreign Application Priority Data

Aug. 28, 1998 (FR) ..... 98 10803

(51) Int. Cl.[7] ..... G02B 7/02

(52) U.S. Cl. ..... 351/177; 351/175; 351/168

(58) Field of Search ..... 351/168, 171, 351/177, 175, 169, 170, 172

(56) References Cited

U.S. PATENT DOCUMENTS

| | | | |
|---|---|---|---|
| 2,310,925 | A | 2/1943 | Bardwell |
| 2,869,422 | A | 1/1959 | Cretin-Maitenaz |
| 5,430,504 | A | 7/1995 | Muckenhirn |

*Primary Examiner*—Scott J. Sugarman
(74) *Attorney, Agent, or Firm*—Millen, White, Zelano & Branigan, P.C.

(57) ABSTRACT

The invention concerns a method for producing multifocal correction lenses from semi-finished lenses (1) having at least a first positioning marker M, associated with a correction A called distant vision correction, and a second positioning marker M' associated with a correction B called near vision correction. The method comprises a step which consists in a surface grinding of the semi-finished lens (1) on an internal surface of said lens. The latter is inclined at a specific angle (β), for example using a wedge, so as to induce a prism of prismatic deviation such that the distant vision and the near vision optical centres are brought together and merge. The invention also concerns a system controlled by a data processing device, for example a micro-computer (8), for automatically carrying out the surface grinding step using a recorded programme and parameters input (80) by an operator.

10 Claims, 4 Drawing Sheets

METHOD FOR PRODUCING A MULTIFOCAL CORRECTION LENS, AND SYSTEM FOR IMPLEMENTING SAME

The invention concerns the production of multifocal correction lenses, in particular optical lenses for human-vision improving glasses when the necessary correction varies depending upon the distance of the observed object. Such is the case for presbyopia which, as is well known, mainly leads to lenses having a double or triple focus (so-called bifocal or trifocal lenses), or to lenses wherein the focal distance progressively varies from one point of the lens to another (commonly called progressive lenses). The invention in particularly concerns a method for producing such lenses, as well as a system for implementing such a method, i. e. in particular an automated system for producing correction lenses, controlled by a data processing system with a recorded program.

In the prior art, it is interesting to recall that the U.S. Pat. No. 2,310,925 discloses lenses of the bifocal (for distant-vision and near-vision respectively) or trifocal type, U.S. Pat. No. 2,869,455 discloses the invention of progressive lens and U.S. Pat. No. 5,430,504 describes a production technology for the so-called merged lens wherein the jump between two zones with different focuses is dimmed. These documents widely explain the method for producing multifocal lenses and the machining performed on the front face, or convex external face. Since the curvature radius of the concave face generally is uniform, this convex face is the surface on which the different curvature radii selected on the basis of wished powers are introduced, implying lens thickness variations. It is then assumed that the lens everywhere consists of the same transparent, mineral or organic material.

Those lenses often are blamed for their unaesthetic aspect, resulting from strong thickness variations. Another group of methods dispenses from using a single material having the same reflection index in each zone of the optical lens. Such methods then provide for two materials with different reflection indices, whereby an auxiliary small-diameter lens is incorporated, by fusion, into the material of the main, large-diameter lens. This incorporation again is performed on the front face of the main lens. The main lens is designed for distant-vision correction and the auxiliary lens has a complementary correction for near-vision correction. Both corrections essentially are obtained by the relative value of the refraction indices, without requiring any difference of the curvature radii. The variation of the global power is easily made progressive, from one point of the lens to another, by varying the thickness of the layers having different indices.

These lenses however are not free from inconveniences. In particular, passing from the distant-vision to the near-vision causes image jumps that are troublesome, and unavoidable, for the user. In an attempt to attenuate this type of inconvenience, trifocal lenses can be preferred, but again at the expense of the aesthetic aspect, due to sensible thickness variations. The typical correction ranges, in focal distances, extend from 0,3 to 0,5 m for near-vision, from 0,5 to 1 m for intermediate vision and from 2 m to infinity for distant-vision.

The present industrial conditions in practice imply fabricating semi-finished lenses with various usual corrections which the industry makes available to the opticians, so that the latter only will have to adapt the positioning of the main curvature center for each person. Those conditions furthermore tend to favor the aesthetic aspect since they resort to an index variation (plus potentially a progressive power variation by surfacing) rather than a thickness variation, without taking into account the fact that the angular deviation between the view orientations in distant-vision and near-vision varies from one person to the next. More generally, nothing is done to insure an optimal user comfort.

The main object of the present invention consequently is an improvement of the visual comfort adapted to each person, without however neglecting the aesthetic aspect. An additional object is the respect of the optimal conditions for industrial feasibility, in particular by starting from semi-finished lenses such as those that presently are available, and operating easy to use, low cost equipment.

To meet these objects in a method for producing vision correction lenses wherein near-vision correction results from a power addition as compared to distant-vision correction, the invention essentially proposes performing on an internal face of each lens a mechanical machining that adds a prismatic deviation, with a reduction of the lens thickness, which prismatic deviation is calculated, based on an individual distance between a distant-vision application center and a near-vision application center, in order to bring back the optical correction center in near-vision as close as possible to the near-vision application center.

In practice, the method implementation advantageously starts from the semi-finished lenses in which said addition is realized, at least for a major part, by varying the reflection index of the transparent material making up said lens at the level of an external face of the lens, and the complementary machining of the invention is then performed by surfacing the opposite internal face.

For the most common multifocal lenses, with preferably progressive power variation, the prismatic variation to be performed varies between 0,5 and 1,5 dioptries. In the simplest case, it is applied as a single correction, centered along the view motion axis between distant-vision and near-vision. It then is very easily obtained by interposing a properly sized wedge, between the semi-finished lens and its support, in order to bring out of center the machining axis, by spherically milling the internal face of the lens.

To further improve the operating conditions and the industrial practice of the invention, it often is advantageous to admit that the deviation data to be taken into account, between the distant-vision and near-vision centers, is the same for all individuals who have the same addition value for near-vision correction, for a determined distant-vision correction value.

In a preferred embodiment for industrial applications, the invention particularly concerns a method for producing, in particular for presbyopia glasses, a multifocal correction lens from a semi-finished lens with determined optical characteristics, whereas said semi finished lens comprises a first concave face and a second convex face and includes at least a first positioning marker M associated with a so-called distant-vision correction A, and a second positioning marker M', associated with a so-called near-vision additive correction B, both located on said convex face and consisting of points, said method being characterized in that it at least includes a surfacing step wherein material is removed at a determined depth from one of said faces by means of abrasion machining means being translated along a first axis, in that said surfacing step includes presenting said semi-finished lens so that it faces said machining means and that a second axis orthogonal to a tangent plane at the point constituting said first positioning marker M is inclined at a determined angle with respect to said first axis, so as to induce into the semi-finished lens a prism aligned on said rectilinear segment $\overline{MM'}$ and having an apex angle which is a function of said inclination angle, and in that the prismatic deviation Δ', in dioptries, of said induced prism complies with the relation:

$$\Delta'=(\overline{MM'}\times A)+Y\times(A+B)$$

where $\overline{MM'}$ is the distance in centimeters between said points M and M', A and B are said corrections expressed in dioptries, and y is the distance in centimeters between the point M' and the optical near-vision center of said correction lens.

The invention will be better understood and further features and advantages will appear when reading the following description, taking in conjunction with the appended figures in which.

Figure 4:
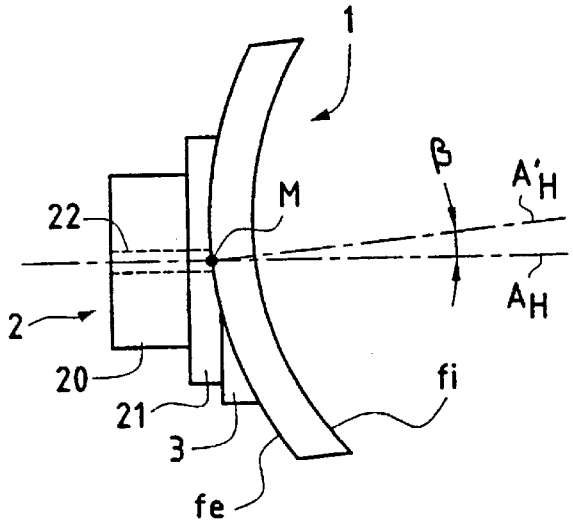
Figure 5:
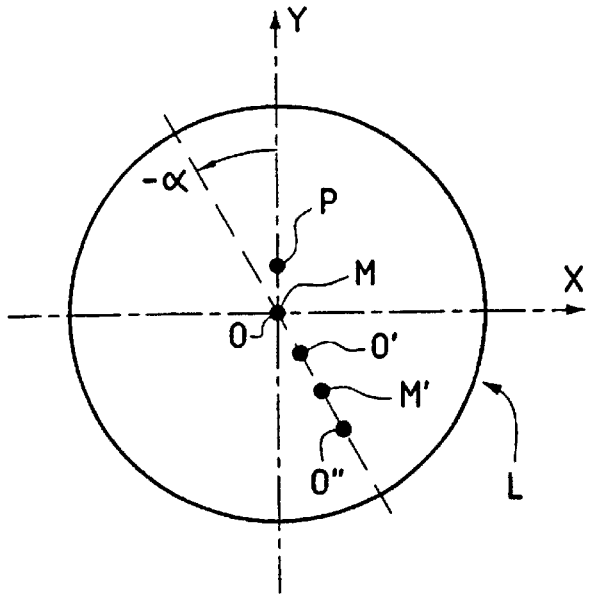
Figure 6A:
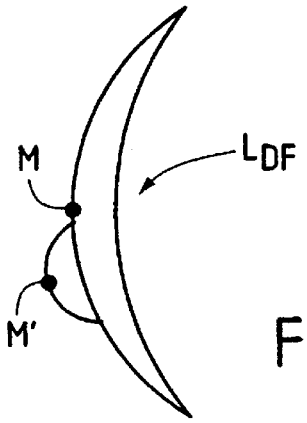
Figure 6B:
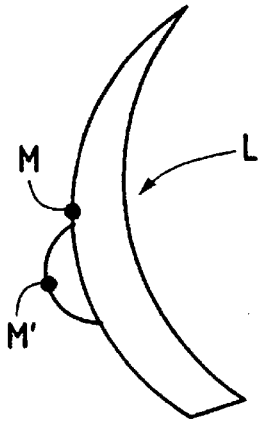
Figure 7A:
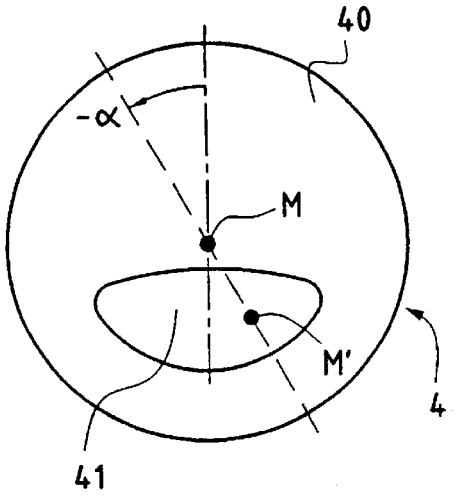
Figure 7B:
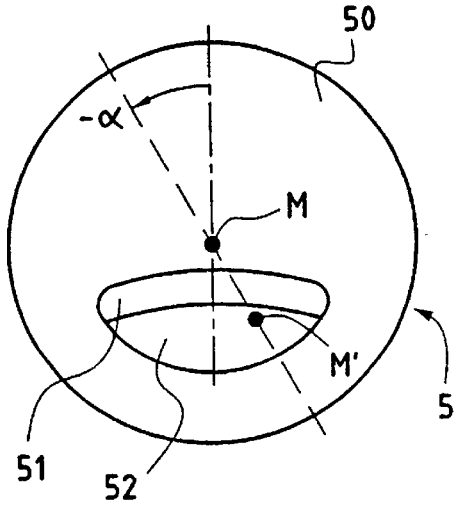
Figure 8A:
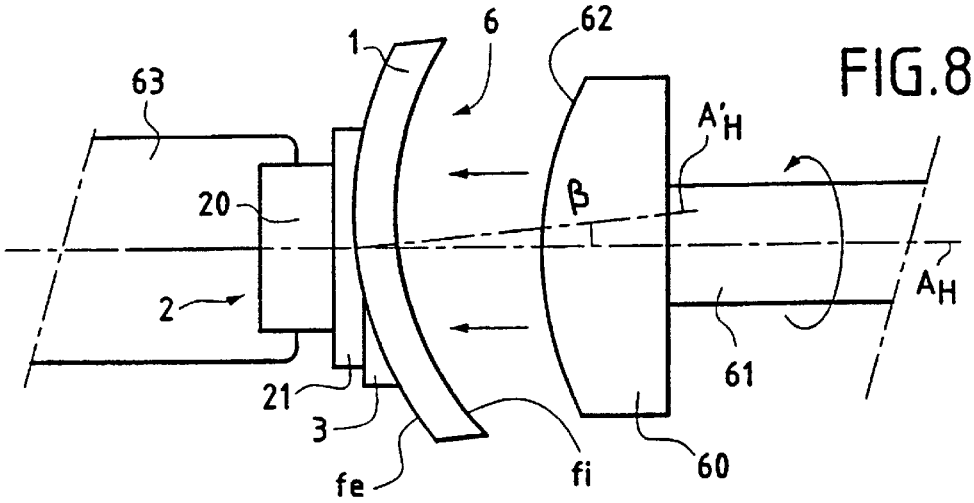
Figure 8B:
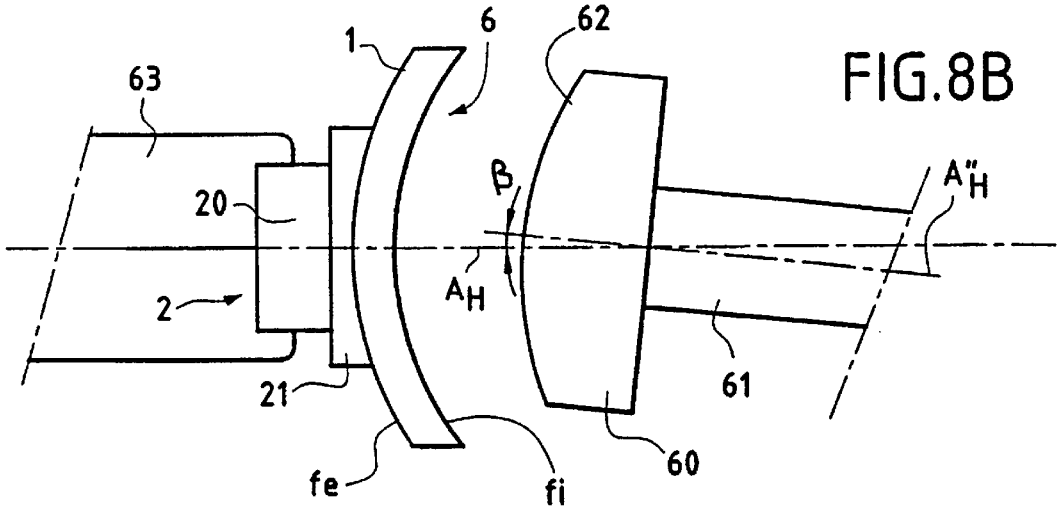
Figure 9:
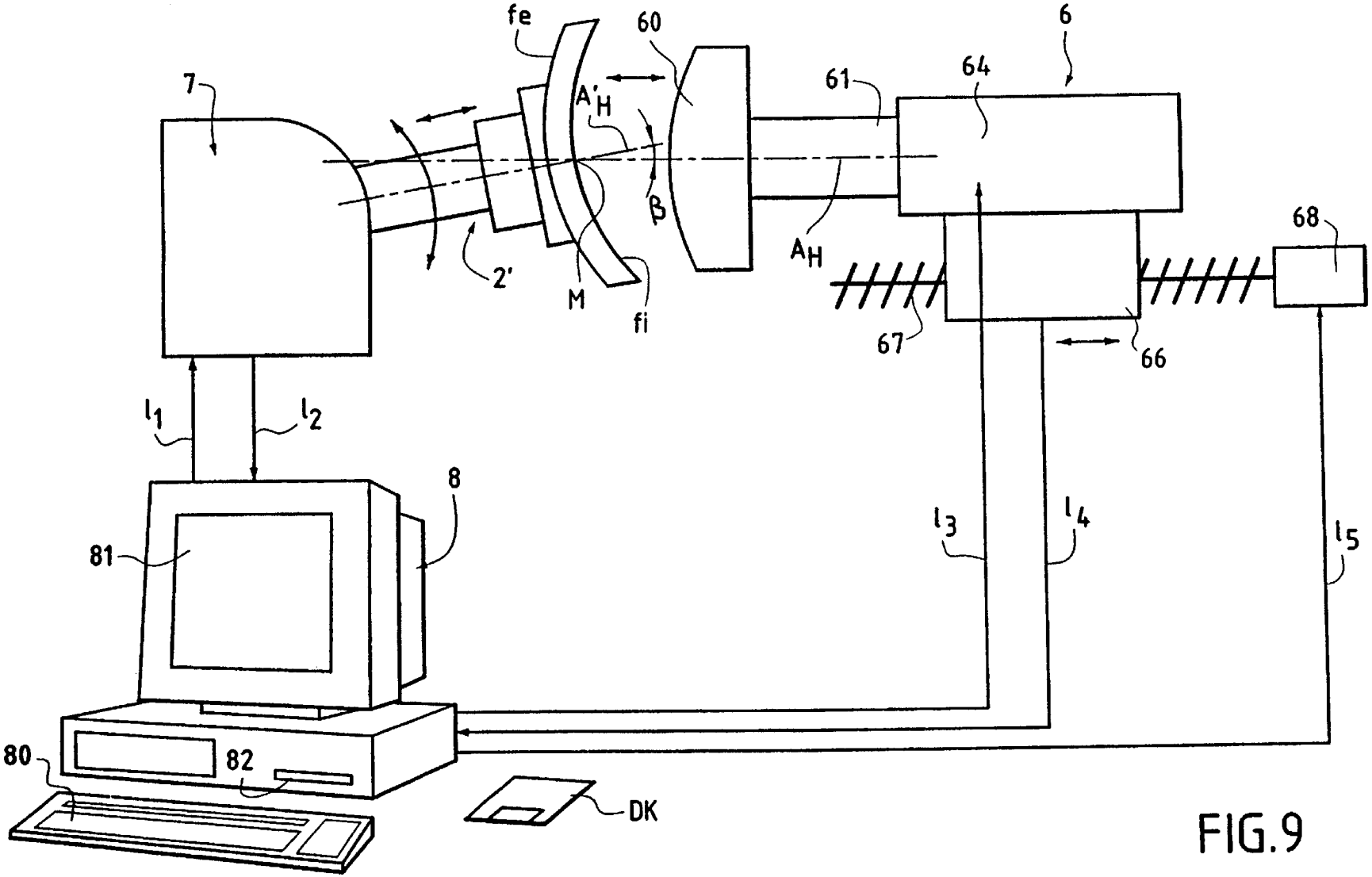

FIG. 4 schematically illustrates a preliminary step, before surfacing a semi-finished lens, which consists of securing the semi-finished lens on a support before surfacing it;

FIG. 5 illustrates a progressive correction lens and the various optical references that characterize it;

FIGS. 6A and 6B schematically illustrate exemplary bifocal correction lenses, with and without a deviation prism, respectively;

FIGS. 7A and 7B schematically illustrate front views of a bifocal and a trifocal lens, for right-hand eye correction;

FIGS. 8A and 8B schematically illustrate two alternative surfacing devices for producing a system of the invention; and FIG. 9 schematically illustrates an automatized surfacing system controlled by a data processing system with a recorded program.

Figure 1:
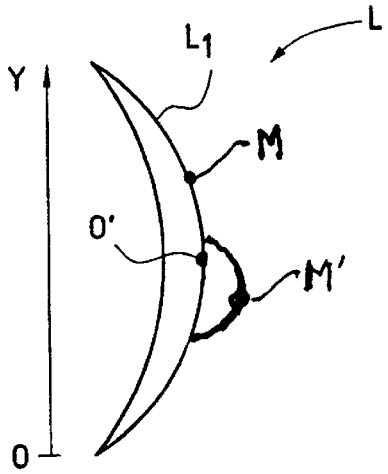
FIG. 1 illustrates the principle of an addition by index variation in a traditional bifocal correction lens.

The problem which the present invention remedies to is easily understood when considering a vision correction lens for a presbyope, produced as a bifocal lens as schematically represented in FIG. 1, and the positions of the optical centers.

This lens L supposedly consists of two lenses: a main lens $L_1$ which optical characteristics defined for distant vision and a smaller auxiliary lens $L_2$, of a different index, that is joined on the front face of the lens $L_1$ (the external face of a pair of glasses) and introduces a necessary additive correction for near vision.

The optical centers of both lenses are not coincident but are shifted along a direction, here a vertical direction OY, supposedly corresponding with the view movement direction when the user passes from distant vision (in principle at the center of the final lens) to near vision (in principle downward oriented) and conversely. Punctual markings M and M' respectively, corresponding with the optical centers of both lenses $L_1$ and $L_2$, are visible on the lens surface. The mark M materializes the so-called application center for distant vision, and the marker M' the application center for near vision. Note that both lenses cannot be physically distinguished in the case of a progressive lens. M is then defined as the center where the progression starts and M' as the center where the progression ends.

Figure 2A:
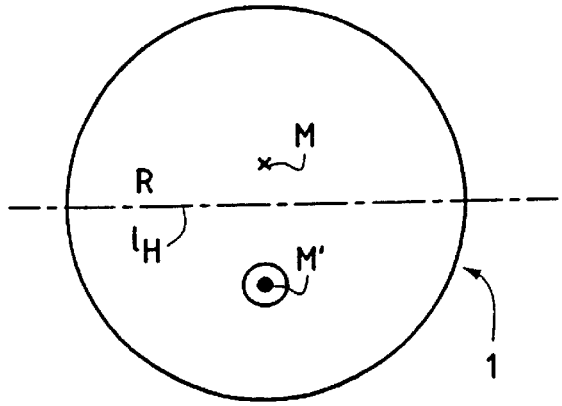
FIGS. 2A and 2B illustrate a front view and a side view, respectively, of an exemplary semi-finished lens from which the final correction lens of the invention will be produced.
Figure 2B:
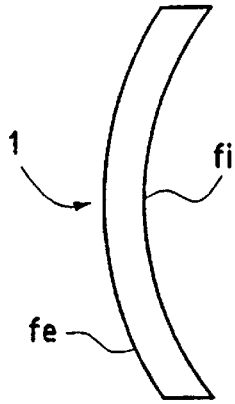

In practice, an industrially produced semi-finished lens usually consists of a circular lens 1, as schematically illustrated by the front and side views of FIGS. 2A and 2B, respectively. The level difference when passing from the main to the auxiliary lens is visually imperceptible. The front or external face, fe, is convex-shaped with a proper curvature radius and the internal surface fi has a concave curvature, parallel to the external face. The external face fe has several markers on its surface for guiding the surface-machining step of the final correction lens, with a thickness reduction, according to a method, which will be disclosed later. The figures in particularly show the point M, the point M' being surrounded by a small circle, an axis $I_H$ designated as horizontal axis since it is perpendicular to the imaginary line joining points M and M', and an additional marking for distinguishing between two semi-finished lenses respectively for a right-hand eye and a left-hand eye (for instance an "R" for the right-hand eye, as illustrated in FIG. 2A).

Figure 3A:
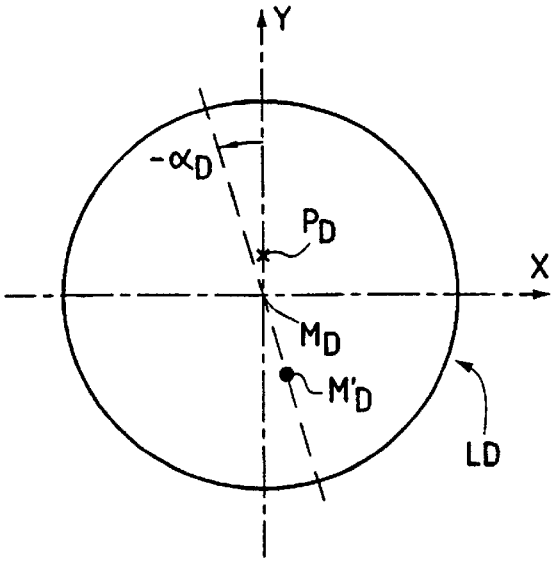
FIGS. 3A and 3B illustrate two correction lenses, for a right-hand eye and a left-hand eye, respectively.
Figure 3B:
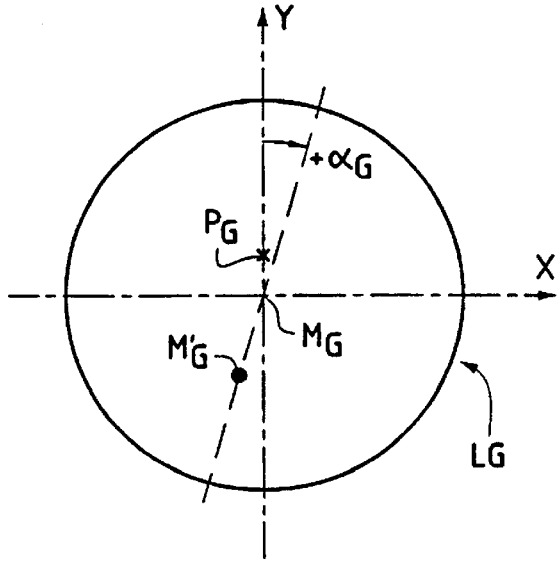

In fact, the movement of the bearer's eye pupil normally is not strictly vertical, when his or her view passes from one vision to the other, for instant from a distant-vision to a near-vision. FIGS. 3A and 3B schematically represent a pair of correction lenses, respectively designated by $L_D$ and $L_G$ for the right-hand eye and the left-hand eye of a glass-bearer. The meaning of the references $M_D$, $M_G$, $M'_D$ and $M'_G$ is the same as for the above references M and M', but they are associated to the right-hand eye and the left-hand eye, respectively. Orthonormal XY axes centered on points $M_D$ and $M_G$, respectively, are represented on the correction lenses $L_D$ and $L_G$. If the pupil centers of both eyes are projected on the vertical axis Y, respectively in $P_D$ and $P_G$, it easily is ascertained that both rectilinear segments $M_D$–$M'_D$ and $M_G$–$M'_G$ are inclined, oppositely with respect to the vertical axis Y. In the trigonometric direction, the rectilinear segment $M_D$–$M'_D$ is at an angle $-\alpha_D$ with the vertical axis $M_DY$ and the rectilinear segment $M_G$–M'G at an opposite angle $+\alpha_G$ with the vertical axis $M_GY$. Those angles $\alpha_D$ and $\alpha_G$ usually have the same absolute value, in the order of 7 to 8 degrees.

Reverting now to FIG. 1, this shows a point O' which materializes what may be called the optical correction center for near vision, by analogy with a point O (not represented since supposedly coincident with point M) that constitutes the optical correction center for distant vision, proper to the main lens. Due to the usual lens production conditions, the location of point O' is intermediate between M and M'. For a good quality near-vision, it however is desirable, as provided by the invention, that points M' and O' be coincident or at least very close to one another, such that the view stays centered on the optical center of the used correction zone.

According to the laws of optics, the following relation holds true between the distances MO' and MM':

$$\overline{MO'} = \frac{\overline{MM'}\times B}{A+B} \tag{1}$$

where A represents the distant-vision correction along the MM' axis and B the additive correction for near vision, with both corrections expressed in dioptries. By convention, the positive direction of the vectors is from top to bottom. The above relation clearly shows that the value $\overline{MO'}$ normally is not zero. The larger the distant-vision correction, the larger the distance between O' and M'. This results in near-vision deformations, which cause troubles, potentially even nausea, for the user. This inconvenience can be remedied to, in particular in progressive lenses, by creating an induced-prism effect, as will now be disclosed.

As already indicated previously, a correction lens is produced by machining a semi-finished lens (see FIGS. 2A and 2B) that advantageously was selected, in a standard range, on the basis of the amplitude of the corrections to be obtained. As schematically illustrated in FIG. 4, the semi-finished lens 1 is arranged on a support 2 that includes a substantially cylindrical main body 20 topped by a ring-shaped crown 21 acting as a receptacle for the external face (convex in the example of the FIG. 4). The semi-finished lens 1 is adhesively blocked by means of an easily melted metal.

The positioning is performed with the help of markings on the surface of the external face fe (see FIG. 2A). For this purpose also, a through-running channel 22, with an axis $A_H$, may be provided in the cylindrical body 20 and the ring-shaped crown 21 Point M can thus be seen both from front and from behind and be positioned at the center of the opening of this channel 22

According to an additional arrangement, a wedge-shaped shim 3 is inserted between the external face fe and the crown 21 in order to induce a prismatic optic deviation into the finally obtained lens. There consequently is an angle β between the axis $A_H$ and the axis $A'_H$ that is orthogonal to the tangent plane in M to the surface of the external face fe. It should be noted here that the shim 3 in practice is not a full object. It preferably is materialized by three tips such that adjustable movements thereof are controllable to modify the orientation and angle of the prism.

In order to produce the final correction lens, a machining is then performed by surfacing the internal (concave) face. The assembly consisting of the lens 1 and support 2 is presented to a (non-represented) machine tool, with the support being locked in a reception member and a priori being movable along the axis $A_H$. Since the lens 1 in inclined with respect to the axis $A_H$, the desired prism is reproduced during the machining operation, with an apex angle depending upon the shim angle, but in the opposite direction.

According to the invention, the value of the added prism is calculated so as to optimize the position of O'. This allows guaranteeing both a good compatibility with the currently available technological means in the optical industry, and an instantaneous and comfortable near-vision reading, independently from any distant vision correction and any necessary addition, in particular for progressive lenses. Since the reading application center directly is at its ideal position, any effort in searching for it can be avoided. All near-vision deformations are very strongly attenuated and the intermediate visions are instantaneous. Passing from distant vision to intermediate and/or near vision is performed without any image jump for all correction lens types, either bifocal, or trifocal, or with a progressively variable correcting power.

In the case of progressive lenses, it may be admitted that the eye rotation angle, in an angular view movement, substantially is constant, typically in a range from 37 to 38 degrees. This allows adopting particularly advantageous implementations of the invention. The implementation of the method of the invention will now be described in a more detailed manner, while referring to FIG. 5 which shows a front view of an exemplary progressive-type correction lens.

The main characteristically markings of this lens L are drawn on this FIG. 5:

M: center where the progression starts, which also will be called blocking center since it is used as a reference for positioning the semi-finished lens (see FIG. 4);

M': end of progression;

O: optical center in distant vision;

O': by analogy, optical center of the semi-finished lens in near vision (in fact a combination of near vision and distant vision);

O": optical center, again in near vision, but taking into account the presence of an induced prism along the axis MM', a characteristic feature of the invention;

A: distant-vision correction along the reference axis MM';

B: additional correction value (near vision)

Δ':prismatic deviation added to the correction lens, expressed in dioptries;

α: angle between the axis MM' and the vertical Y-axis of a orthonormal referential system XY.

In a normally surfaced lens, i.e. Without any prismatic correction, points O and M are coincident and the position of O' is given by the relation (1). However, for a good quality near vision, points M' and O' need, according to the invention, to be coincident or at least very close to one another. In order to obtain this result, the invention provides for adding a vertical prism to the lens during the surfacing step. The prism should have a lower basis, i.e. Be positive, for a lens associated with a positive correction A; and it should have an upper basis, i.e. be negative, for a lens associated with a negative correction A. A particular case happens when A=0 In this limit case, no additional prism is needed.

In order to clarify the explanation, FIGS. 6A and 6B schematically illustrate examples of bifocal correction lenses $L_{DF}$ and $L'_{DF}$ respectively without and with a vertical prism. For illustration purposes, the figures are not drawn to scale, in order to better evidence the prismatic configuration in the correction lens $L'_{DF}$ of FIG. 6B.

When a vertical prism is introduced, this introduction results in point O' becoming O". When referring to relation (1), the following relation must hold true for O" and M' to be coincident:

$$\overline{MO''}=\overline{MM'} \tag{2}$$

The laws of optics, which translate the prismatic deviation of any prism by the relation:

$$\Delta=D\times d \tag{3}$$

where D is the power in dioptries and d the distance in centimeters, allow expressing the prismatic deviation Δ of the inventive correction lens (for instance $L'_{DF}$ of FIG. 6B) as a function of $\overline{MM'}$, B and A to cause points O" and M' to be coincident.

The following relation is obtained:

$$\Delta'=\overline{MM'}\times A \tag{4}$$

In this case, when the optical power is expressed in dioptries and the distances in millimeters, the position of O becomes:

$$\overline{MO}=\frac{10\Delta'}{A}=\frac{10\times\overline{MM'}\times A}{10\times A} \tag{5}$$

hence $$\overline{MO}=\overline{MM'} \tag{6}$$

There follows that both optical centers O and O" are coincident. For this reason, it can be guaranteed that there is no image jump or movement. The visual comfort also is optimized since M' and O" are coincident and there consequently is no deformation in a near-vision image.

A preferred embodiment of the invention for a safe industrial practice, however, only includes machining the internal face for reducing the lens thickness and consequently acting on the basic lens power for distant-vision, without modifying the addition zone for near-vision as figured by the index variation of the material on the external face of the lens. A single prism effect that will be the same all over the lens will consequently be added. The calculation of the thus induced prismatic deviation furthermore can be still simplified by admitting that the distance between the application center in near-vision and the application center in distant-vision on the lens is the same for all persons requiring the same correction (distant-vision plus near-vision addition) with a same type of no multiple or progressive lens.

Supposing that O" should be moved over a distance y with respect to M', along a vertical direction or, more precisely, along the axis MM' (FIG. 5), a prism Δ' should be provided with a power complying with to the following relation:

$$\Delta'=(\overline{MM'}\times A)+Y\times(A+B) \tag{7}$$

where A and B are expressed in dioptries and the distances are expressed in centimeters. If y is sufficiently small, the results thus obtained are very close to those obtained when the relation (4) is complied with. The relation (7) consequently is the more general relation, while the relation (4) strictly is verified when y=0.

To clarify the explanation, the implementation of the method of the invention will now be detailed for three particular cases of lenses, namely with bifocal lenses, trifocal lenses and progressive lenses.

FIG. 7A schematically illustrates a front view of a bifocal lens 4 for a right-hand eye correction. It includes two distinct zones: the main lens 40 and a so-called "chip", i.e. a small zone 41 that constitutes the near-vision zone. Both points M and M' located in the zones 40 and 41 respectively also are represented on this FIG. 7A.

If $A_{OD}$ and $A_{GO}$ are the corrections to be reached for the right-hand eye and the left-hand eye, respectively, and if the inclination α of the axes MM' supposedly is +8 degrees and −8 degrees with respect to the vertical, then $A_{OD}$ and $A_{OG}$ traditionally comply with both following relations (where the angles are expressed in degrees and $A_{OD}$ and $A_{OG}$ in dioptries):

$$A_{OD}=SPH+CYL\cos(\gamma-8) \tag{8}$$

and $$A_{OG}=SPH+CYL\cos(\gamma+8) \tag{9}$$

where γ is the astigmatism axis angle, SPH is the value of the correction lens sphere and CYL is the astigmatism value of the correction lens.

In this case, the prism to be added according to the method of the invention typically is given by the relation $$\Delta'=A \tag{10}$$

for a distance MM' usually equal to 10 mm.

FIG. 7B schematically illustrates a front view of the trifocal lens 5 for correcting the right-hand eye vision. It comprises three distinct zones: the main lens 50 and two small superimposed zones 51 and 52 for the intermediate vision and the near vision, respectively. As previously, both points M and M' located in the zones 51 and 52, respectively are represented on this FIG. 7B.

In the case of trifocal lenses, the average distance between M and M' typically is 16 mm. The relation (10) consequently becomes:

$$\Delta' = \frac{16A}{10} \tag{11}$$

The method of the invention also applies to progressive lenses. Those in fact constitute the preferred embodiment of the invention since the advantages obtained in both an improved visual comfort and an appreciated aesthetic aspect are particularly substantial here, while respecting the industrial feasibility. The prismatic deviation added to the traditional semi-finished lens, calculated as a function of the distance MM' (which represents an individual angular spacing between near vision and distant vision) and the power addition between distant vision and near vision, while bringing O' (the optical center for near vision) closer to M' according to the invention, also cause the optical center O to be more distant from the point M. This however in practice only exerts a perfectly negligible incidence on the visual comfort, due to the extent of the visual fields since the near-vision correction (3 dioptries for instance) for most presbyope is substantially larger than the distant-vision correction (0.5 to 1 dietary in the other direction).

Such lenses already are represented in FIGS. 3A and 3B Reverting to the example of FIG. 3A (right-hand eye correction), the projection of the pupil center on the lens is represented in $P_D$. The distance between $P_D$ and $M_D$ equals 2 mm, on the average. The distances between $M_D$ and $M'_D$ and between $P_D$ and $M'_D$ respectively are 14,5 and 16,5 mm. $M'_D$ is 2 mm shifted towards the inside. The 16,5 mm distance between the points $P_D$ and $M'_D$ corresponds to a vertical eye angle rotation in the order of 37 or 38 degrees, to pass from the distant vision to the near vision. The same value will naturally be found for the left-hand correction lens eye (FIG. 3B: LG).

The axis $M_DM'_D$ substantially is vertical, similar to the case of bifocal and trifocal lenses, but with a slightly larger deviation angle, typically 12 degrees, with respect to the vertical. The relations (8) and (9) then become:

$$A_{OD}=SPH+CYL\cos(\gamma-12) \tag{12}$$

and $$A_{OG}=SPH+CYL\cos(\gamma+12) \tag{13}$$

The ideal value for Δ' typically is given by the following relation (29=2×14,5 mm):

$$\Delta' = \frac{29A}{20} \tag{14}$$

For a $\overline{M'O''}$=y shift (in millimeters), the value of the prism Δ' consequently is given by the relation:

$$\Delta' = \frac{29A + 2y(A+B)}{20} \tag{15}$$

The complete method for producing correction lenses of the invention will now be described. As reminded earlier, the lenses will be produced from commercial semi-finished lenses available from various companies. Producing those lenses is not directly within the scope of the invention. The lens-surfacing step to obtain the features of the expected result, notably to comply with the relation (4), is perfectly compatible with the technologies used in the prior art, which offers a definite advantage.

According to a first method of the invention, as described in reference to FIG. 4 which now is reverted to, a semi-finished lens 1 (see FIGS. 2A and 2B) is positioned on a support 2 having a body 22 and a ring-shaped crown 21 for receiving the semi-finished lens 1. As already indicated, the positioning is performed with the help of the visible markings on the convex surface (FIG. 2A: fe) of the semi-finished lens 1. In order to obtain the required prismatic deviation value Δ', a prismatic insert 3 (prism Δ) is introduced according to this embodiment between the semi-finished lens 1 and the support 2.

For bifocal and trifocal lenses, the prism value Δ is identical to the value Δ'. This prism value consequently complies with the relation (10) or (11) for a bifocal or a trifocal lens respectively.

For progressive lenses on the other hand, the induced prism on the lens Δ' differs from the prism physically represented by the shim Δ. Wherever an approximation corresponding to the most frequent cases of a presbyope is not considered as satisfactory, corrections should be added for Δ' to comply with the above relation (15), when the dimensions of the inserted shim (FIG. 4:3) are taken into account. Practice shows that establishing a mathematical formula describing the above-mentioned corrections for a correlation between the shim dimensions and the induced prism is inappropriate, and an experimental calibration is preferred to determine such correlation.

The first step consists in determining a so-called "rough" shim value for the prismatic shim, supposing that Δ=Δ'. Physically, the apex angle of the prismatic shim is equal to the apex angle of a prism equivalent to Δ'. Corrections then must be added in a second step for reaching the final expected results. These corrections are experimentally determined, for instance by performing comparisons on prototypes produced with various addition values B and a set of predetermined prismatic shims, for Δ>0 and Δ<0. No addition is needed if the prism value is Δ=0, as previously noted. Furthermore, obtaining is equivalent to inserting one shim in the positive direction and two identical shims in the negative direction. This operating mode simplifies the shim insertion process. The above mentioned corrections allow refining the results and obtaining a convergence between the finally obtained prismatic corrections and the desired value, i.e. The value complying with the relation (14).

After performing these preliminary operations, the final correction lens can be obtained by a surfacing method compatible with the traditional method of the prior art.

FIG. 8A illustrates one of the currently used methods. A so-called surface generator is used as a machine tool 6. It includes a milling cutter 60 such that the diameter of its abrasive front face 62 advantageously is substantially equal to or larger than the diameter of the semi-finished (commonly circular) lens 1 and the curvature radius is equal to the radius of the convex face fe. The body 20 of the support 2 of the semi-finished lens 1 is locked by jaws 63 or any similar member, of a fixed support (not represented), mechanically coupled with the machine tool 6. The milling cutter 60 is placed at the end of a revolving shaft 61, the symmetry axis of which is coincident with the symmetry axis $A_H$ of the support 2. When the milling cutter is translated along this axis $A_H$, it will machine the concave face fi of the lens 1. Since this axis is slanted at an angle β with respect with the axis $A_H$, the surfacing process causes both a material removal and the creation of a prism in the lens, in a direction opposite to the shim 3. The action on the lens 1 is continued, in a manner well known per se, until a predetermined correction lens thickness is obtained.

An exemplary milling cutter 60 is made of diamond material and typically rotates at a speed of 4500 rpm.

The following step, in a manner well-know per se, consists of polishing and buffing both surfaces fe and fi potentially, but not necessarily, after having brought them back in a normal position, i.e. Wherein the lens is not slanted, in an identical manner for both surfaces. Those operations do not significantly modify the correction values obtained in the surfacing step. Lens surface treatments, such as an anti reflection treatment, also can be performed on the external face fe.

The lens finally is cut according to a predetermined template, again in a well-known manner per se. The final lenses are not necessarily circular. The correction lenses, for both eyes, are cut according to the lens mount that will hold them.

The just described surfacing method introduces a physical prismatic shim, that will induce into the lens an opposite prism of a strictly identical value for bifocal or trifocal lenses or an approximate value for the progressive lenses. The same effect can be obtained without introducing any prism. The same effect namely is obtained if the semi-finished lens has a symmetry axis coincident with the axis of the support 2 and if the milling axis is slanted with respect to the symmetry axis.

FIG. 8B schematically illustrates this milling method. The shaft 61 that supports the body of the milling cutter 60 rotates around an axis $A''_H$ which is at an angle β with respect to the axis $A_H$. The device of FIG. 8A is perfectly dual of the device of FIG. 8B. It must be clearly understood that this concerns a relative slant of both axes $A_H$ and $A''_H$ and that the latter potentially may stay horizontal. It namely can be simpler to slant, in an appropriate manner, the support holder 63 rather than the rotating shaft 61 of the machine tool 6. Both methods also can be combined.

Finally an other known way consists of locking the semi-finished lens with the help of three tips solitary with the support, at least one of which has a length different from the others. There follows that the semi-finished lens is supported by a tripod and, as previously, is presented in a slanted manner to the milling cutter. If the lengths of all three tips are equal, an alternative similar to the alternative of FIG. 8B can be implemented.

Still other methods also are well known, in particular a method that resorts to a small milling cutter and scans the whole surface of the semi-finished lens. This method generally gives less precise results and the milling cutter will very rapidly wear off.

A preferred embodiment includes a possible complete automation of both the semi-finished lens machining step and the step of producing the prism with the predetermined value (i.e. Complying with one of the relations (4) or (7), in general, and one of the relations (10), (11), (14) or (15), in particular, depending upon the type of correction lens to be obtained).

FIG. 9 schematically illustrates a complete system allowing such an automation.

A first rotating motor 64 drives the shaft 61 that supports the milling cutter 60. The support 66 for this motor is mechanically coupled to a second rotating motor 68, for instance by means of a gear including a worm or a rack 67, (or any similar device), that will drive the support 66 along an horizontal axis $A_H$. A step motor also can be used instead of the rack 67 and the rotating motor 68. The system finally includes a sliding way type device affixed on a planar support (not represented) or any similar device for guiding the horizontal translation of the motor 64 and holding this motor.

In the exemplary embodiment described in FIG. 9, the semi-finished lens, with a symmetry axis $A'_H$, is attached with a support, referenced here by 2'. The support 2' itself is supported by a motorized positioning apparatus. It is spatially positioned in such a way that the point M is on the horizontal axis $A_H$ (the horizontal axis and the symmetry axis of the shaft 61) and that the symmetry axis $A'_H$ of the semi-finished lens 1 is at a predetermined β angle with the axis $A_H$. This angle β is such that the value of the induced prism Δ' that complies with one of the previously mentioned relations will be obtained. In order for those two requirements to be simultaneously satisfied, the support 2' needs two degrees of freedom: namely a rotation around an horizontal axis orthogonal to the axis $A_H$, for obtaining the inclination angle β, and a translation along the axis $A'_H$ to place the point M on the axis $A_H$.

The various motorized members are controlled by a data processing system 8, with a recorded program, which system, for instance includes a general purpose microcomputer with one or several (not represented) specific cards, with appropriate input and output ports where the various motorized members will be connected through specialized or standard connections (parallel, serial).

In FIG. 9, the data processing system is a microcomputer 8 with standard peripherals, in particular a display 81, a keyboard 80 and a diskette reading unit 82. The figure also represents the main connections between the microcomputer 8 on the one hand and the motorized members 7, 64 and 68 on the other hand.

The connection $I_1$ transmits commands to the member 7 for controlling the positioning of the support 2', in both rotation and translation. This support is associated with one or several traditional sensors, in particular (not represented) position sensors, for instance of the onto-electronic type. Such sensors allow determining, among others, the spatial position of the semi-finished lens 1. Markings (see FIG. 2A) on the surface fe of the semi-finished lens 1 can be used for this purpose since the exact position of the fixed horizontal axis $A_H$ is known. An optical reading of the spatial positions of those markings can in particular be performed.

An additional connection $I_2$ transmits to the microcomputer the result of the performed measurements, no matter how they were performed. The microcomputer can then exert, via the connection $I_1$, a real time control of the movement of the semi-finished lens 1 such that the above mentioned positioning requirements are satisfied, and it can block the lens in a position proper for presenting it to the milling cutter 60 at the required inclination angle β. Both connections $I_1$ et $I_2$ naturally can be grouped into a single bidirectionally connection.

The microcomputer 8 controls the operation of the motor 64 through the connection $I_3$. This can imply either simple on-off commands, or also commands for controlling the rotation speed of the motor 64.

The microcomputer 8 finally controls the back-and-forth translation of the milling cutter 60, along the axis $A_H$, by means of the motor 68 and the worm 67 acting on the base 66 of the motor 64 (in the described example). A connection $I_5$ transmitting the back-and-forth motion commands to the motor 68 is provided for this purpose. A (not represented) position sensor that at any time transmits data defining the position of the milling cutter 60 also is needed. It can be an electro mechanical transducer or an optoelectric transducer; coded wheel, etc., coupled with the worm 67.

If the motor 68 is of the stepper type, digital data representing the position of the actuator acting on the basis 66 of the motor 64 generally are available. Such data can be directly used by the microcomputer 8, without requesting any analog to digital conversion. Connection $I_4$ transmits the measurement signals for the position of the milling cutter 60 along the axis $A_H$. Here again, both unidirectional connections $I_4$ and $I_5$ can be grouped into a single bidirectionally connection.

It should be clear that. All connections $I_1$, $I_3$ and $I_4$ for controlling the motorized members 7, 64 and 68, do not normally transmit any electric power signals but only act upon electromechanical switches (relays etc.) And/or electronic switches (semi-conductor switches, etc.) Arranged between the traditional electrical and/or fluidity supply circuits (not represented) and those motorized members.

The microcomputer 8 records, in the mass memory (hard disk, not represented) which it is usually is equipped with, all data and program commands for the production of correction lenses, in particular for the surfacing machining step. It even more practically records, according to the main characteristics of the invention, the data and commands necessary for obtaining the prism induced into the lens and complying with the relation (4), in a general manner, or with any of the specific relations (10), (11) or (14) in a more particular manner, depending upon the type (bifocal, trifocal or progressive) of the correction lens to be obtained.

In the case of progressive lenses, since the induced prism obtained, with a value Δ', cannot here be directly directed derived from the value of the angle β, it also is useful to record a data base of the experimental results for a range of prototypes produced with various values for angles β and additions B. These data are then used to introduce the above mentioned corrections.

The data and program commands can initially be input, either manually through the keyboard 80, or preferably by reading a diskette DK (diskette reading unit 82) or any other magnetic or optical support, as long as the microcomputer 8 has an appropriate reading unit. The data and commands also can be downloaded into the microcomputer, via a modem. This arrangement is particularly advantageous if the correction lens production site is in a store that is part of a store chain. The programs and applicative data can then be elaborated in a centralized manner and be made available in real time, simply by interrogating a central data base available to all subscribers, either for producing correction lenses, or to initialize and update a local data base.

Those skilled in the art will directly understand that the recorded control programs and/or data associated therewith are easily modified or updated, in order for instance to take into account the availability of new types of semi-finished lenses, or more simply to correct errors in the program or improve the performances. Such modifications also are compulsory when another machine tool is used or when some components of the machining chain are replaced. This feature adds to the flexibility of the method.

In an operational functioning mode, an operator will input the necessary parameters for implementing the surfacing step on the correction lens to be realized, while taking into account all parameters associated with this step: features of the basic semi-finished lens, type of correction lens and values of corrections to be obtained (A, B), angular deviation β to obtain the prism Δ', potentially correction parameters for progressive lenses (or at least an indication that such correction should be introduced to insure that the program then automatically introduces them). The data and commands being input will be displayed on the screen 81 in a text and/or graphics form. As an example, the program can display a menu including questions which the operator will answer for entirely defining the correction lens he or she wants to produce. The program can in response display on the screen 81 the features or the model of the semi-finished lens that should be used, if those data were input at the previous step.

The operator can then initiate the surfacing step proper, which is automatically performed under control of the recorded program which he or she has parameterized at the previous step. This surfacing step is performed in the previously described manner, with big-directional data and/or commands being exchanged through the various connections $I_1$ to $I_5$ between the microcomputer 8, the motorized members 7, 64 and 68 which it controls, and the sensors, in particular the position sensors associated with those motorized members.

Other types of supports naturally can be used for the semi-finished lens 1, for instance a three-tip type support. All that is required is that the symmetry axes of the semi-finished lens 1 and the milling cutter 60 are at a determined angle β, so as to induce into the lens a prism that complies with the relation (4), which allows the points M', O' and O" to be coincident, or almost coincident, when the relation (7) is verified.

The method also is compatible with the production of a correction lenses for astigmatism by using the relations (8) and (9) or (12 and (13).

In the light of the preceding description, those skilled in the art will clearly see that the invention does reach its object.

The producing method, comprising a surfacing step, allows obtaining multifocal, in particular bifocal, trifocal and progressive correction lenses, and offers many advantages. Those correction lenses, in particular do not cause the disagreeable phenomenon of image jump when passing from one vision mode to another (distant vision to near vision, for instance). The near-vision deformations are imperceptible. Those lenses offer both a substantial reading comfort and an instantaneous adaptation.

The production method is compatible with prior-art technologies and allows using, as the basic material, currently available semi-finished lenses selected in a standard range.

And the method, according to a preferred alternative embodiment, finally allows a large process automation by using computerized means.

It however should be clear that the invention is not limited to the only exemplary embodiments explicitly described above, in particular in relation with FIGS. 5 to 9. Other technologies, of which only some were detailed, can in particular be used for the surfacing step.

What is claimed is:

1. A method for producing vision correction lenses from semi-finished lenses having a power addition for near-vision correction with respect to distant-vision correction, wherein a mechanical machining that adds a prismatic deviation is performed on an internal face of each lens, through reducing the thickness thereof, and this prismatic deviation is calculated, based on an individual distance between a distant-vision application center and a near-vision application center, in order to bring back the optical correction center in near-vision as close as possible to the near-vision application center.

2. The method of claim 1 for producing, in particular for presbyopia glasses, a potentially progressive, multifocal correction lens from a semi-finished lens with determined optical characteristics, by varying the index and/or thickness, wherein, said semi finished lens comprising a first concave face and a second convex face and including at least a first positioning marker M associated with a so-called distant-vision correction A that materializes said application center for distant-vision, and a second positioning marker M', associated with a so-called near-vision additive correction B that materializes said application center for near-vision, said method includes at least a surfacing step wherein material is removed at a determined depth from one of said faces, preferably said internal face, by means of abrasion machining means being translated along a first axis ($A_H$, $A''_H$), said surfacing step including presenting said semi-finished lens so that it faces said machining means and that a second axis ($A'_H$) orthogonal to a tangent plane at the point constituting said first positioning marker M is inclined at a determined angle (β) with respect to said first axis ($A_H$, $A''_H$), so as to induce into the semi-finished lens a prism aligned on said rectilinear segment $\overline{MM'}$ having an apex angle which is a function of said inclination angle (β), and wherein the prismatic deviation Δ', in dioptries, of said induced prism complies with the relation:

$$\Delta'=(\overline{MM'}\times A)+Y\times(A+B)$$

in which $\overline{MM'}$ is the distance in centimeters between said points M and M', A and B are said corrections expressed in dioptries, and y is the distance in centimeters between the point M' and the optical near-vision center of said correction lenses.

3. The method of claim 1, wherein said semi-finished lens is selected in a standard range for said distant-vision correction A and consists of a substantially circular-shaped glass block having determined optical characteristics, with said block being inscribed between two faces having identical curvature radii, one of which is a convex, so-called external face and the other is a concave, so-called internal face, and wherein said mechanical machining comprises a surfacing step performing a material removal from said concave face at a determined depth, with the semi-finished lens being presented to machining means at an inclination angle (β) including said prismatic deviation.

4. The method of claim 3, comprising a preliminary step consisting of:

securing said semi-finished lens on a support having a symmetry axis, placing between said support and said semi-finished lens a prismatic shim with an apex angle equal to said inclination angle (β), but in a direction opposite to said induced prism to be produced, so as to obtain a same inclination of this semi-finished lens with respect to said symmetry axis, and placing said support so that it faces said machining means with said symmetry axis being coincident with a translation axis of said machining means.

5. The method of claim 2, including a preliminary step consisting of:

securing said semi-finished lens on a support having a symmetry axis ($A_H$) so that this symmetry axis ($A_H$) is coincident with said second axis ($A'_H$), and placing said support so that it faces said machining means and that said symmetry axis ($A_H$) is at an angle equal to said inclination angle (β) with said translation axis ($A''_H$).

6. The method of claim 3, including, when said correction lens to be realized is of the bifocal type, a step of selecting a value for the inclination angle (β) corresponding to an apex angle of the induced prism such that the prismatic deviation of said prism Δ' is equal to said distant-vision correction A expressed in dioptries.

7. The method of claim 3, including, when said correction lens to be realized is of the trifocal type (5), a step of selecting a value for the inclination angle corresponding to an apex angle of the induced prism such that the prismatic deviation of said prism complies with the following relation $$\Delta' = \frac{16A}{10}$$

where A is said distant-vision correction expressed in dioptries.

8. The method of claim 3, including, when said correction lens to be realized is of the so-called progressive (L) type:

a first step of selecting a so-called rough inclination angle value (β) equal to the apex angle of a prismatic deviation prism that complies with the relation:

$$\Delta' = \frac{29A}{20}$$

where is said distant-vision correction expressed in dioptries, and a second step of correcting said rough angle value with the help of experimental data so that said prismatic deviation of the prism induced into the lens will converge towards said relation $$\Delta' = \frac{29A}{20}$$

where said experimental data is obtained from comparative measurements of a series of progressive-lens prototypes with determined prismatic deviation corrections and additive corrections.

9. A system for producing a multifocal correction lens, in particular for glasses, by implementing a method according to claim 1, comprising:

a support for said semi-finished lens with inclination means for slanting said support with respect with a horizontal axis ($A_H$), machining means comprising an abrasive milling cutter for a said concave face of the semi-finished lens, wherein said machining means comprise a rotating motor driving said abrasive milling cutter at a determined angular speed, and motorized means for translating said milling cutter along said horizontal axis ($A_H$) so as to implement a surfacing step removing material from the lens up to a determined depth in said concave face.

10. The system of claim 9, wherein said inclination means of the semi-finished lens are motorized, wherein said system includes position sensors, for measuring the spatial instantaneous positions of said motorized inclination means, said abrasive milling cutter and said translating motorized means for said abrasive milling cutter, and a data processing system with a recorded program, including at least means for inputting and collecting data and program instructions and storing these data, and wherein said data processing system controls said motorized inclination means, said rotating motor and said translating motorized means for said abrasive cutter, based in particular on said measurements by said position sensors and on parameters collected via said data inputting and collecting means by an operator, so as to present said semi-finished lens to said machining means at said inclination angle (β) , based on of said corrections to be produced.

* * * * *